US008424442B2

(12) United States Patent
Ward et al.

(10) Patent No.: US 8,424,442 B2
(45) Date of Patent: Apr. 23, 2013

(54) TILE GRID SUBSTRUCTURE FOR PULTRUDED BALLISTIC SCREENS

(75) Inventors: Nathaniel J. Ward, Warwick, RI (US); Lucine Kabakian Reinbold, Cranston, RI (US); Ernest C. Faccini, Londonderry, NH (US); Alf L. Carroll, III, Marion, MA (US)

(73) Assignee: Raytheon Company, Waltham, MA (US)

( * ) Notice: Subject to any disclaimer, the term of this patent is extended or adjusted under 35 U.S.C. 154(b) by 906 days.

(21) Appl. No.: 12/370,315

(22) Filed: Feb. 12, 2009

(65) Prior Publication Data

US 2012/0186426 A1 Jul. 26, 2012

(51) Int. Cl.
*F41H 5/04* (2006.01)

(52) U.S. Cl.
USPC ..... 89/36.02; 89/917; 52/385; 52/389

(58) Field of Classification Search ..... 52/385, 52/389–392, 315; 89/36.02, 917
See application file for complete search history.

(56) References Cited

U.S. PATENT DOCUMENTS

| | | | | | |
|---|---|---|---|---|---|
| 1,836,964 | A | * | 12/1931 | Grigsby et al. | 52/387 |
| 2,031,684 | A | * | 2/1936 | Berger | 52/396.1 |
| 3,177,568 | A | * | 4/1965 | Schweiker | 29/707 |
| 3,239,981 | A | * | 3/1966 | Fitzgerald | 428/44 |
| 3,319,392 | A | * | 5/1967 | Fitzgerald | 52/389 |
| 3,335,048 | A | * | 8/1967 | Morain | 428/48 |
| 3,344,011 | A | * | 9/1967 | Goozner | 428/67 |
| 3,444,033 | A | * | 5/1969 | King | 428/49 |
| 3,616,115 | A | * | 10/1971 | Klimmek | 109/84 |
| 3,666,606 | A | * | 5/1972 | Stokes | 428/48 |
| 3,745,735 | A | * | 7/1973 | Casano | 52/390 |
| 4,862,668 | A | * | 9/1989 | DeGooyer | 52/747.11 |
| 4,928,575 | A | * | 5/1990 | Smirlock et al. | 89/36.02 |
| 4,953,341 | A | * | 9/1990 | Joos | 52/747.11 |
| 4,969,386 | A | * | 11/1990 | Sandstrom et al. | 89/36.02 |
| 5,705,764 | A | | 1/1998 | Schade et al. | |
| 5,924,694 | A | | 7/1999 | Kent | |
| 6,532,857 | B1 | * | 3/2003 | Shih et al. | 89/36.02 |
| 6,601,497 | B2 | | 8/2003 | Ghiorse et al. | |
| 6,823,640 | B1 | * | 11/2004 | Pytlewski | 52/677 |
| 7,198,860 | B2 | * | 4/2007 | Vance | 428/701 |
| 7,516,558 | B2 | * | 4/2009 | Frank et al. | 33/526 |
| 7,520,205 | B1 | * | 4/2009 | Colliflower et al. | 89/36.02 |

(Continued)

FOREIGN PATENT DOCUMENTS

| | | | |
|---|---|---|---|
| DE | 37 14 907 | * | 5/1987 |
| WO | 98/37376 | * | 8/1998 |
| WO | 2009/145827 | * | 3/2009 |
| WO | 2009/045584 | * | 4/2009 |

*Primary Examiner* — Robert Canfield
(74) *Attorney, Agent, or Firm* — Lando & Anastasi, LLP

(57) ABSTRACT

An armor component includes a plurality of tiles disposed on a rigid support. At least one spacer is disposed between the adjacent edges of the tiles to establish a minimum gap between the adjacent edges. The gap is filled with a gap filling material, which optionally includes a reinforcement additive. The spacers can be in the form of a spacer tray having a plurality of spacer segments and a plurality of tile cut-outs, with the tile cut-outs separated from adjacent tile cut-outs by a spacer segment, and tiles disposed one to each tile cut-out in the spacer tray. The armor component is in some embodiments placed between two fabric layers and fed into a pultruder, where it is impregnated with resin and heated to cure the resin to form a laminate armor.

26 Claims, 9 Drawing Sheets

U.S. PATENT DOCUMENTS

| | | | | |
|---|---|---|---|---|
| 7,703,375 | B1 * | 4/2010 | Scott et al. | 89/36.02 |
| 7,752,955 | B2 * | 7/2010 | Engelbart | 89/36.02 |
| 2005/0257468 | A1 * | 11/2005 | Serros et al. | 52/396.1 |
| 2006/0102276 | A1 * | 5/2006 | deWitt | 156/250 |
| 2007/0011898 | A1 * | 1/2007 | Frank et al. | 33/526 |
| 2010/0089228 | A1 * | 4/2010 | Scott et al. | 89/36.02 |
| 2011/0036234 | A1 * | 2/2011 | Fisher | 89/36.02 |

* cited by examiner

TILE GRID SUBSTRUCTURE FOR PULTRUDED BALLISTIC SCREENS

BACKGROUND OF INVENTION

1. Field of Invention

Ballistic screens are frequently employed to provide a barrier that prevents projectiles, such as rifle fire, machine gun fire, and/or cannon fire, from penetrating into a structure and may be used to protect both personnel and/or hardware, such as aircraft, ships, and land vehicles. Generally, the use of a hard inner core, often of a grid of ceramic tiles, stops the projectile and a spall layer behind it "catches" the fragments, preventing penetration.

During use, the ceramic tiles may be damaged upon receiving an impact. Tile-to-tile gaps are required to reduce the shockwave that spreads across the face of the screen during impact, and must be sized properly and filled with a material that provides protection in the case of a direct hit.

SUMMARY OF INVENTION

In a first aspect, an armor component includes a plurality of tiles, each tile having an edge that is adjacent an edge of another tile. At least one spacer is disposed between the adjacent edges of the tiles to establish a gap between the adjacent edges. The spacers in some embodiments include at least two spacer arms (for example, three, four or more spacer arms). The spacers in some embodiments are configured to abut a corner of a tile, with each spacer arm extending along an edge of the tile and disposed between adjacent tiles. The width of the spacer arms in some embodiments sets the minimum width of the gap between adjacent tile edges. In some embodiments, the gap is between about 0.015 inches and about 0.050 inches in width. In some embodiments, the gap is filled with a gap filling material, such that the space between adjacent tiles is substantially filled with the gap filling material. In some embodiments, the tiles and spacers are disposed on a rigid support. The armor component in certain embodiments is capable of being fed through a pultruder, meaning that the various components of the armor component are capable of withstanding pultrusion conditions such as, for example, the elevated temperatures and/or pressures at which the resins of the pultrusion process cure. For example, in some embodiments, the armor component is capable of withstanding temperatures of at least about 450° F.

In another aspect, a component includes a spacer tray having a plurality of spacer segments and a plurality of tile cut-outs, with the tile cut-outs separated from adjacent tile cut-outs by a spacer segment. A plurality of tiles are disposed one to each tile cut-out in the spacer tray. The spacer segments separate adjacent tiles and establish a gap between adjacent tiles. In some embodiments, the spacer segments have a height that is less than half the height of the tiles. In some embodiments, the gap between tiles that is not occupied by the spacer segments is filled with a gap filling material, which can comprise a reinforcement additive. The component in certain embodiments is capable of being fed through a pultruder, meaning that the various elements of the component are capable of withstanding pultrusion conditions. In some embodiments, the tiles are ballistic tiles.

In another aspect, a laminate component includes first, second, third and fourth layers. The second layer comprises a rigid support. The third layer includes a plurality of tiles each tile having an edge adjacent an edge of another tile, with at least one spacer disposed between the adjacent edges of the tiles to establish a gap between the adjacent edges. A gap filling material is disposed in the gap between the tiles. The width of the spacer arms in some embodiments sets the minimum width of the gap between adjacent tile edges. In some embodiments, the gap is between about 0.015 inches and about 0.050 inches in width. In some embodiments, the gap filling material includes a reinforcement additive. In some embodiments, the tiles are ballistic tiles.

In still another aspect, a method of making tiled armor includes the steps of placing tiles and spacers on a rigid support and arranging the tiles and spacers so that there is at least one spacer between adjacent tiles. The spacers create a gap between adjacent tiles of between about 0.020 inches and about 0.040 inches. The spacers in some embodiments contact at least two adjacent tiles. In some embodiments, a gap filling material is disposed in the gap between adjacent tiles to form a tile sub-assembly. In some embodiments, the gap filling material includes a reinforcement additive. In some embodiments, the tile sub-assembly is sandwiched between a first layer and a fourth layer to make a composite sub-assembly. In some embodiments, the composite sub-assembly is impregnated with resin, and the resin is cured, for example, by heating the composite sub-assembly to the cure temperature of the resin. In some embodiments, at least the steps of impregnating the composite sub-assembly with resin and curing the resin are preformed using a pultruder.

BRIEF DESCRIPTION OF DRAWINGS

The accompanying drawings, which are incorporated into and constitute a part of this specification, illustrate several aspects and embodiments of the invention and together with a description of certain embodiments, serve to explain the principles of the balloon catheters disclosed herein. The drawings are not intended to be drawn to scale. In the drawings, each identical or nearly identical component that is illustrated in various figures is represented by a like numeral. For purposes of clarity, not every component may be labeled in every drawing. A brief description of the drawings is as follows.

DETAILED DESCRIPTION

Figure 1:
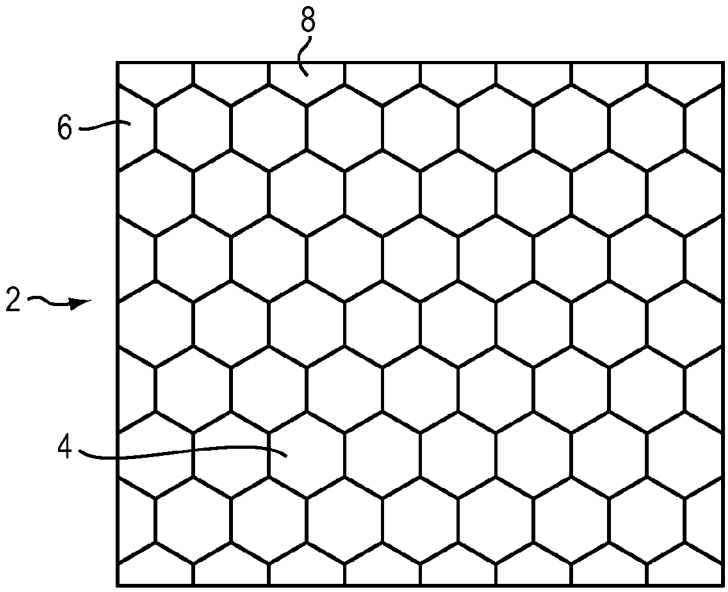
FIG. 1 is a top view of a tile array.
Figure 2A:
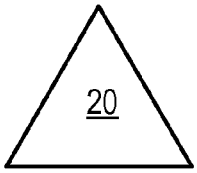
FIGS. 2A-2E are top views of tile embodiments.
Figure 2B:
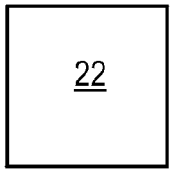
Figure 2C:
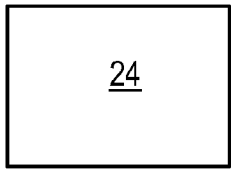
Figure 2D:
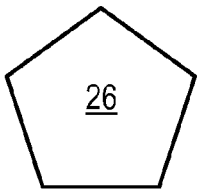
Figure 2E:
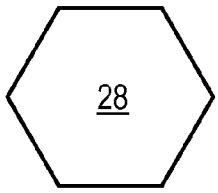
Figure 3:
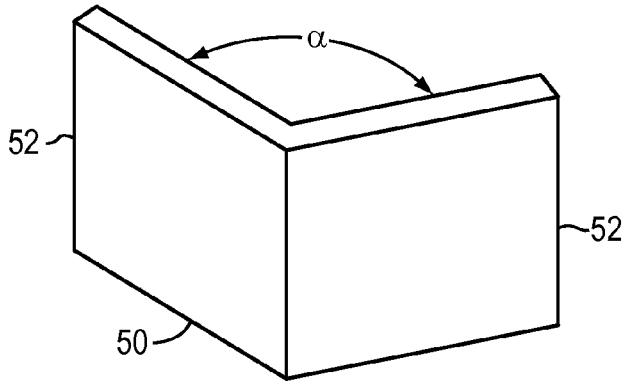
FIG. 3 is a perspective view of a spacer embodiment.
Figure 4A:
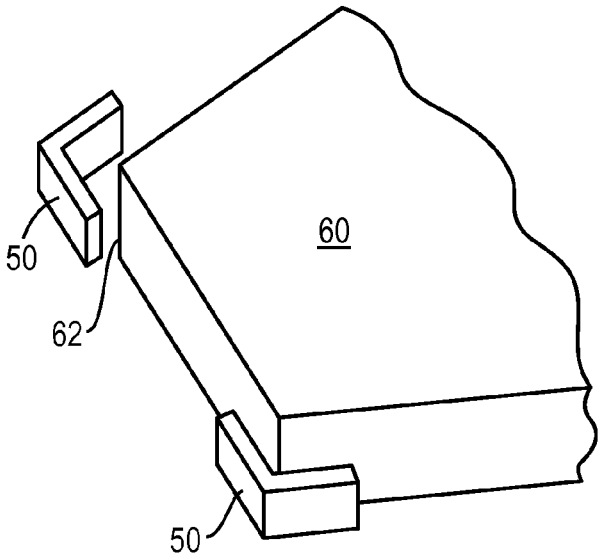
FIG. 4A is a perspective view of spacers being placed against a tile.
Figure 4B:
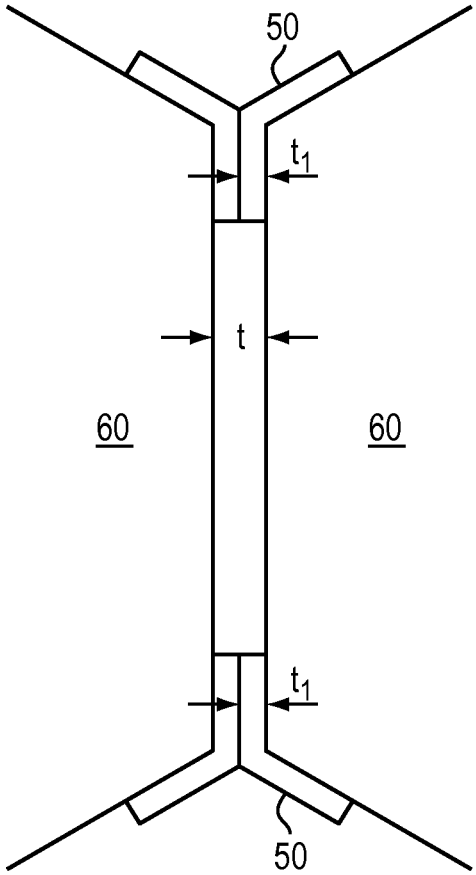
FIG. 4B is a top view of a tile array embodiment including spacers.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

The embodiments described below are not intended to be exhaustive or to limit the invention to the precise forms disclosed in the following detailed description. Rather, these embodiments are chosen and described to illustrate certain principles and practices of the present invention.

Armor in accordance with certain aspects of the invention generally includes a layer of tiles arranged in an array or pattern on a rigid support and separated by a series of spacers. A gap-filling material fills the gap between the tiles. A first layer of fabric lays over the top of the tiles, while a second layer of fabric lays along the bottom of the rigid support. The fabric layers are impregnated with a resin. The entire structure is cured to form an armor composite. As will be discussed herein, a pultrusion apparatus and process can be used to form the finished composite structure. The pultruder permits formation of the armor in a continuous fashion. A pultruded ballistic screen consisting of a composite-backed ceramic tile grid substructure can in certain embodiments provide excellent performance at reduced cost compared to other methods of production.

The tiles in some embodiments are ballistic tiles. Exemplary ballistic tiles include ceramic tiles, for example, non-oxide, high-performance technical ceramic tiles. Such tiles typically have low density when compared with armor metals, as well as high hardness and high elastic modulus. Exemplary ceramic materials include boron carbide, such as, for example, $B_4C$; silicon carbide (SiC), silicon nitride ($Si_3N_4$) and titanium diboride ($TiB_2$).

The tiles are placed in a predetermined arrangement, such that tiles are adjacent one another. For example, as illustrated in FIG. 1, a honeycomb arrangement 2 is achieved by using hexagonal tiles 4 arranged into a honeycomb pattern.

The tiles can be one or more of a variety of shapes. For example, as illustrated in FIGS. 2A-2E, the tiles used in forming the armor can include triangular tiles 20, square tiles 22, rectangular tiles 24, pentagonal tiles 26, and/or hexagonal tiles 28. It is to be appreciated that polygonal tiles of any number of sides can be used. The armor can further include tiles that are portions of any of these shapes. For example, where hexagonal tiles are used as in FIG. 1, half-tiles 6, 8 can be employed as necessary to provide uniform ceramic performance properties out to the edge of the armor panel, for example, to provide straight edges to the armor panel. The thickness of the tiles is selected based on the application in which the armor is to be used. Factors to be considered include the size and weight of the armor (thicker tiles result in a heavier armor) and the types of impacts to be protected against (thicker tiles can generally withstand heavier impacts). In some embodiments, the tiles can be from about 5 mm to greater than 30 mm thick.

In some embodiments, spacers are placed between some or all of the ceramic tiles to align the tiles and produce a gap between tiles. Maintaining these gaps within a specified tolerance range can result in improved screen performance (such as, for example, the ability to withstand multiple hits at adjacent tiles and/or the ability to withstand ballistic impacts at a first tile without having damage propagate to adjacent tiles). For example, in some embodiments the gap between tiles is between about 0.020 inches and 0.040 inches, such as, for example, between about 0.025 inches and about 0.035 inches. In some embodiments, the gap is about 0.030 inches. The spacers can serve to create a gap between neighboring tiles, and to determine the dimension of that gap, as the tile array is formed. The spacers can also preserve the tile-to-tile spacing and preserve consistent gap widths as the tile array is filled with gap-filling material and introduced into the pultruder.

In some embodiments, a spacer is placed between a pair of adjacent tiles and each of the adjacent tiles is put in contact with the spacer. In this way, the width of the spacer determines the minimum width of the gap between the adjacent tiles.

The spacers are in some embodiments formed of a material capable of withstanding the temperatures and pressures of the pultrusion process while maintaining the desired gap between tiles. For example, in some embodiments, materials that will not melt, degrade, deform or soften under the pultrusion conditions are utilized. Exemplary materials include fiberglass, carbon fibers, composite materials, and steel and other metals.

The configuration of the spacers will depend on the shape of the tiles with which they will be used. Generally, there are several possible spacer configurations, which can be modified for particular tile shapes. For example, in some embodiments, as illustrated in FIGS. 3, 4A, 4B and 5, a spacer 50 is employed that comprises two spacer arms 52 that meet at an angle $\alpha$. In the embodiment illustrated, a spacer 50 is placed at each corner 62 of a hexagonal tile 60. Such a spacer can generally be described as "L"-shaped, with the angle at which the spacer arms meet determined by the angle of the tile corner at which it is to be placed. For example, where hexagonal tiles are used, the angle $\alpha$ is 120°, while for square or rectangular tiles, the angle $\alpha$ would be 90°. In some embodiments in which "L"-shaped spacers are utilized, the spacer arms have a thickness $t_1$ that is half the thickness t of the desired minimum tile-to-tile gap. The tiles 60 are arranged so that the spacers 50 of a given tile are adjacent the spacers 50 of the next tile. In this way, when the tiles are placed so that the spacers are abutted, the addition of both spacer thicknesses creates a gap having the desired minimum width. The use of "L"-shaped spacers can in some embodiments result in quick tile array construction, as the tiles will have a spacer in every corner, requiring no special planning as to spacer positioning, and no care needs be taken to ensure that the spacers are in the correct orientation. Additionally, in some embodiments, the use of these spacers can result in a consistent minimum gap width even where tiles of slightly different dimensions (for example, tiles on either end of the tolerance range) are employed.

Figure 5:
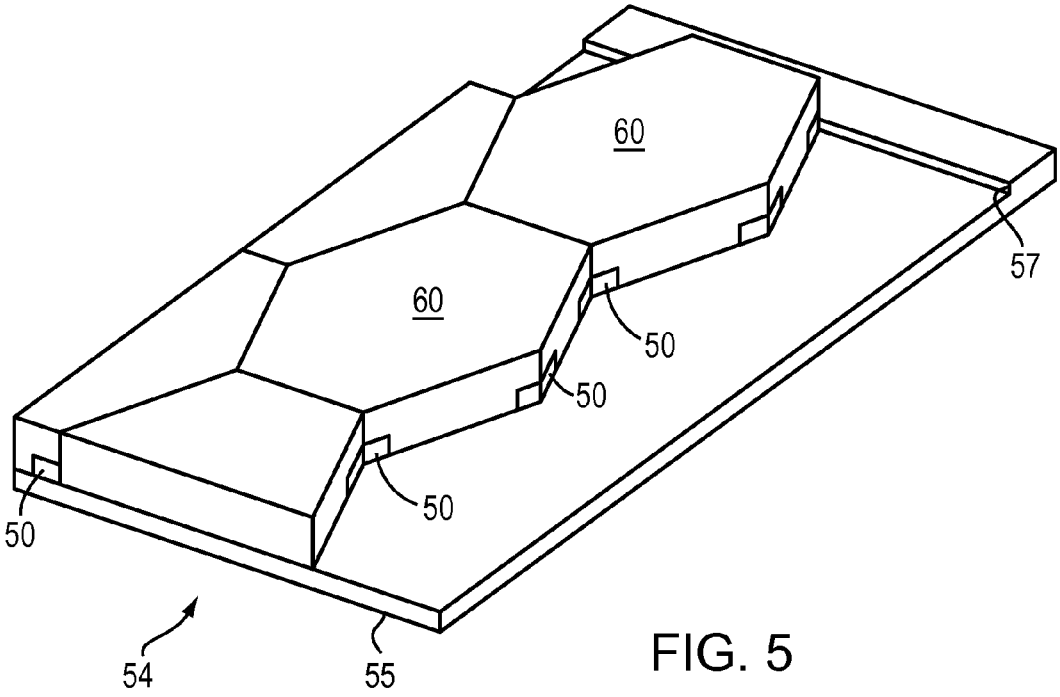
FIG. 5 is a perspective view of a tile array, including spacers, disposed on a rigid support.

In some embodiments, as illustrated in FIG. 5, the tiles 60 and spacers 50 are arranged in an array or pattern 54 on a rigid support 55. The rigid support 55 is a portable tray-like member that serves to hold the tile array for handling and transport to the pultruder, and is itself fed into the pultruder along with the tile array to become part of the armor. The rigid support is in certain embodiments formed of a material having a thickness sufficient, taking into account the strength and rigidity of the material, to support the weight of the tiles (which can in some embodiments weight 150 lbs. or more), spacers, and gap-filling material for handling and introduction into the pultruder. Additionally, the rigid support should be capable of being introduced into a pultruder and of withstanding the pultruder conditions, such as temperature and/or pressure. Exemplary rigid support materials include fiberglass, carbon fiber, composite materials, ceramics, plastics, Kevlar, and metals such as, for example, steel. Optionally, the rigid support includes a lipped edge 57 for containing the outer edge of the tiles and for assisting in retaining the tile array while the array is handled, and optionally is introduced into the pultruder along with the tile array.

Figure 6A:
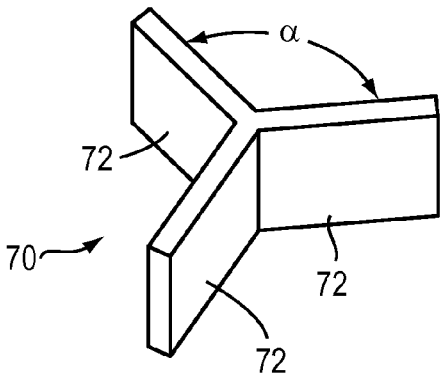
FIG. 6A is a perspective view of a spacer embodiment.
Figure 6B:
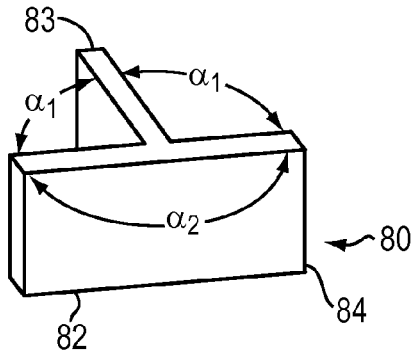
FIG. 6B is a perspective view of a spacer embodiment.
Figure 6C:
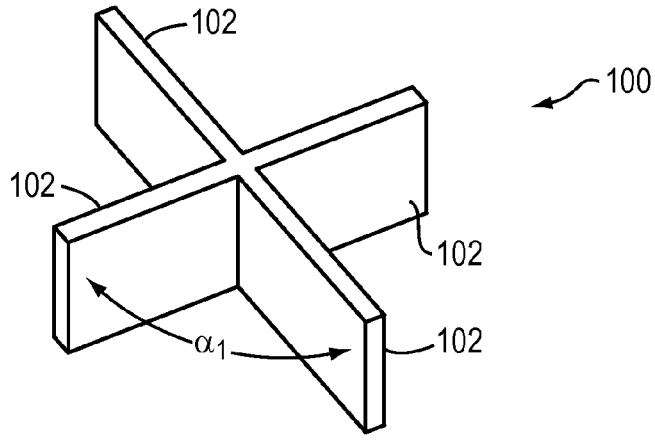
FIG. 6C is a perspective view of a spacer embodiment.
Figure 7C:
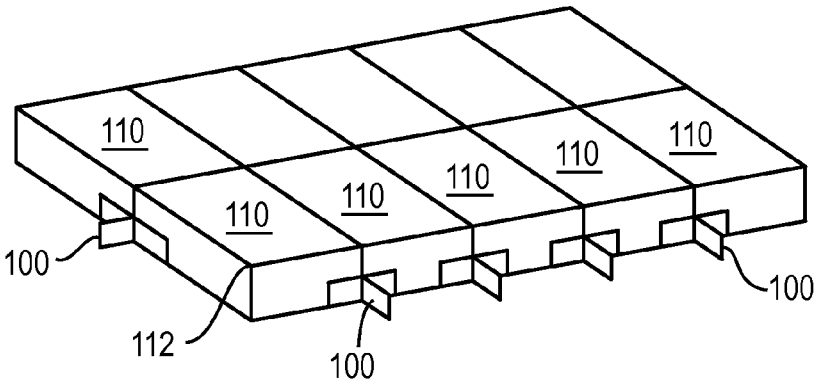
FIG. 7C is a perspective view of a tile array embodiment, including spacers.
Figure 7D:
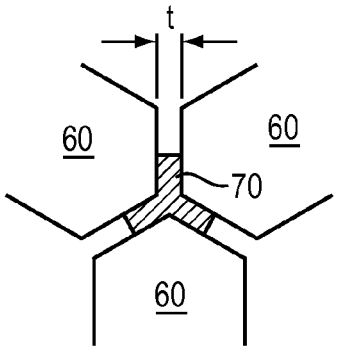
FIG. 7D is a view of a tile array embodiment, including spacers.
Figure 7A:
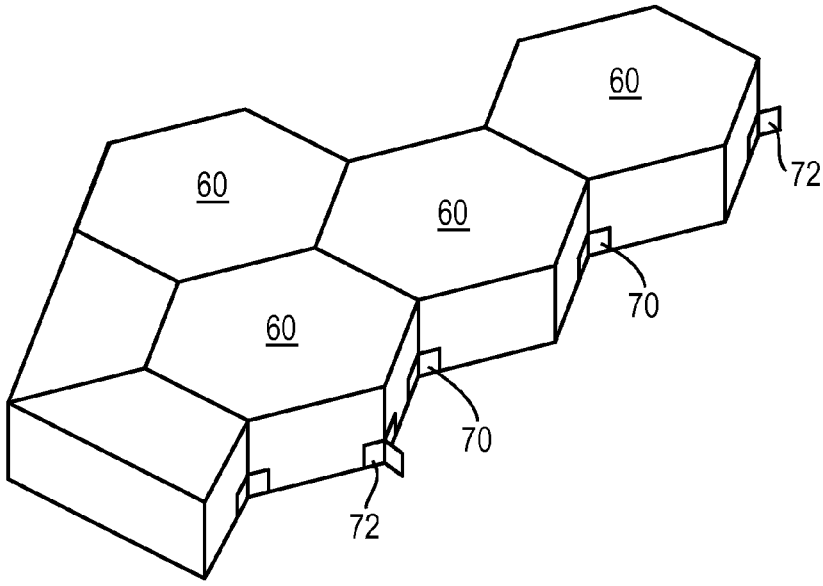
FIG. 7A is a perspective view of a tile array embodiment, including spacers.
Figure 7B:
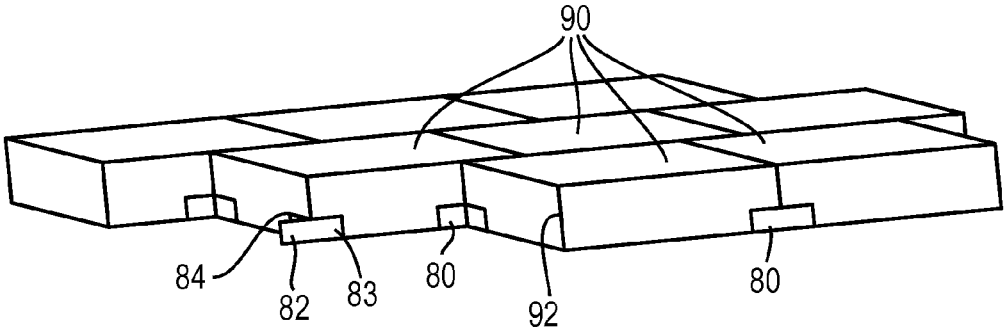
FIG. 7B is a perspective view of a tile array embodiment, including spacers.

In certain embodiments, the spacer comprises more than two spacer arms, for example, three, four, five or more spacer arms. Such spacers can be placed at the points at which the corners of multiple tiles meet to establish a minimum gap between several neighboring tiles. For example, as illustrated in FIGS. 6A and 7A, a spacer 70 having three spacer arms 72, each meeting at angles $\alpha$ of 120° angles, can be placed where the corners of three tiles meet. Similarly, where square tiles are used, spacers having four spacer arms can be employed, with the arms meeting at 90° to form a "+" shape. As another example, illustrated in FIGS. 6B and 7B, spacer 80 includes spacer arms 82, 83 and 84. The angle $\alpha_1$ between spacer arms 82 and 83 and spacer arms 83 and 84 is 90°, while the angle between spacer arms 82 and 84 is 180°. Spacers 80 are placed against the corners 92 of rectangular tiles 90, which are arranged in a staggered configuration. As still another example, spacer 100, illustrated in FIGS. 6C and 7C, include four spacer arms 102, each meeting at an angle $\alpha_1$ of 90°. Spacers 100 are placed against the corners 112 of square tiles 110, which are then arranged in a grid. The spacers in these embodiments have spacer arms having a thickness t that matches the desired minimum tile-to-tile gap thickness t, as illustrated in FIG. 7D. In certain embodiments, spacers having more than two spacer arms permit the spacers to stand freely, which can assist with construction of the tile array, for example, by allowing the tiles and spacers to be loosely arranged and then pushed together.

The spacer arms in some embodiments extend the full height of the tile edge. In other embodiments, the spacer arm extends for only a portion of the height of the tile edge, sufficient to maintain the gap between tiles. For example, the spacer in some embodiments extends no more than half of the height of the tile edge.

In some embodiments, an adhesive is used to attach the spacers to the tiles. This can serve to produce an initial stability to the tile array prior to the addition of gap-filling material and pultrusion of the armor. The spacers can be adhered to some (e.g., one) or all of the tiles to which they are in contact, or, where such a configuration is employed, to the other spacers in which they are in contact in the assembled array. Suitable adhesives in certain embodiments should be compatible with the materials being used in the remainder of the pultruded system and should be able to withstand the thermal and mechanical environment of the pultrusion process.

Figure 8:
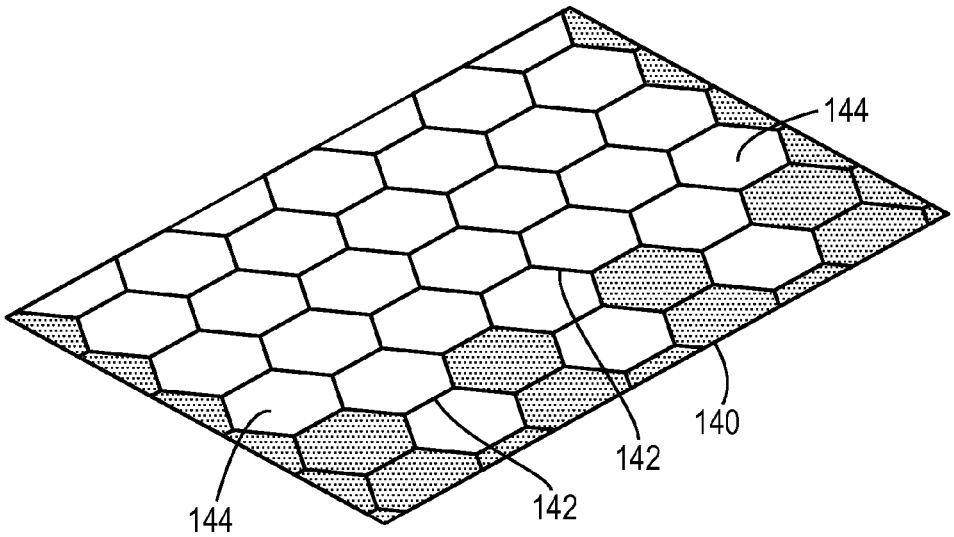
FIG. 8 is a perspective view of a spacer tray.
Figure 9:
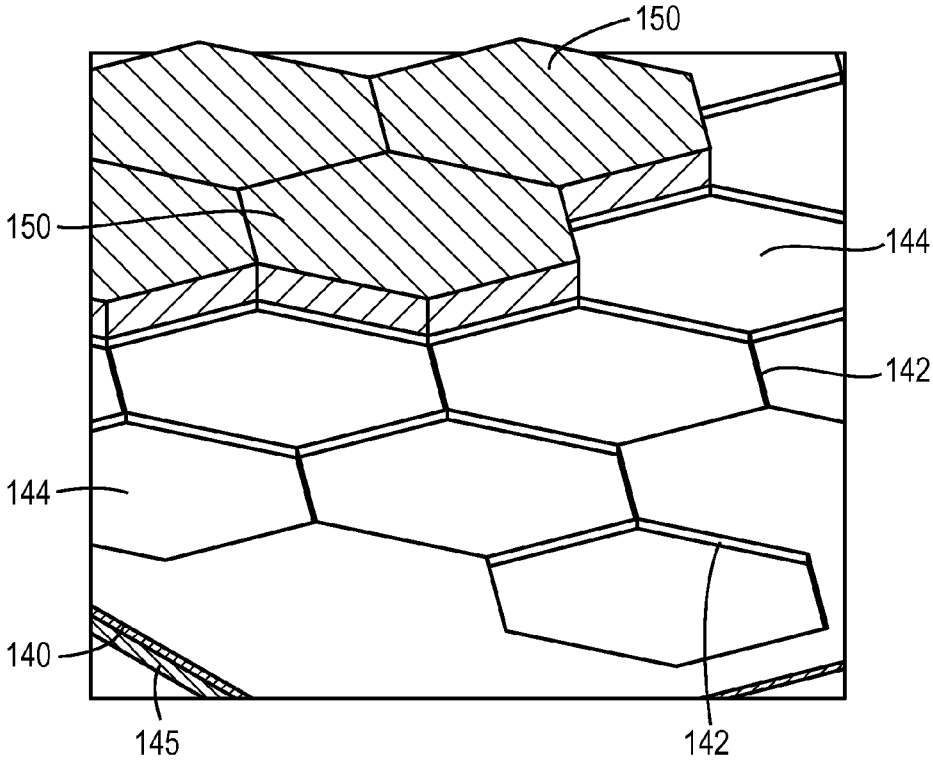
FIG. 9 is a perspective view of a tile array, including a spacer tray, disposed on a rigid support.

In certain embodiments, a spacer tray is utilized to separate the tiles and define the gap between adjacent tiles. For example, as illustrated in FIGS. 8 and 9, spacer tray 140 includes a plurality of spacer segments 142 that define a plurality of tile cut-outs 144. The spacer segments 142 have a height that is less than the height of the tiles 150 with which the spacer tray is used. The tile cut-outs 144 correspond in shape and size to the tiles 150 which are inserted into the tile cut-outs 144. The spacer segments 142 contact an edge 152 of each of two tiles 150, and serve to create a gap between the two tiles 150 above the spacer segment 142. In some embodiments, the spacer segments have a height that is less than half of the height of the tiles with which the spacer tray is used, to permit the majority of the gap between tiles to be filled with gap-filling material.

In certain embodiments, the tiles are measured and the measurements are used to create a spacer tray 140 having tile cut-outs 144 that match up with specific tiles. The cut-outs are in some embodiments formed by removing material from a solid tray, for example, by using a punch, waterjet, laser, mill or other material removal process. In other embodiments, the tray is formed with the cut-outs already in place, as, for example, by injection mold. After forming the cut-outs, the spacer tray is placed on a rigid support 145, and the tiles are placed in their corresponding cut-out.

In some embodiments, once the tile array has been set up according to any of the herein-described methods, a gap-filling material is disposed in the gaps between the tiles. The gap-filling material can reduce the impact shockwave that results from an impact, which can in some circumstances reduce the likelihood of damage to tiles that were not directly impacted. The gap-filling material in some embodiments helps to adhere the tiles to one another and maintain the integrity of the tile array both before and after processing the array through a pultruder. In certain embodiments, the gap-filling material is designed to itself absorb direct impacts and/or improve multi-hit performance. The gap-filling material in some embodiments fills substantially all of the space between adjacent tiles, for example, all of the space not already occupied by a spacer.

The gap-filling material optionally also includes a reinforcement additive. The particular gap-filling material and reinforcement additives are selected based on a number of criteria, with the weight put on each individual characteristic varying depending on the circumstances of manufacture and the environment of intended use. Exemplary manufacturing and material property characteristics of the gap-filling material relate to the conditions the gap-filling material is subjected prior to being disposed between the tiles in the tile matrix (such as, for example, while being shipped, stored, and readied for application to the tile matrix) as well as conditions the gap-filling material, while disposed in the tile grid, may be exposed to while being introduced into the pultrusion machine, during pultrusion or under all operational environments.

One such material characteristic is the maximum temperature that the material can withstand without breaking down or losing other desirable characteristics. Generally, the material must be able to withstand the temperature of the pultrusion process, which can in some embodiments be as high as 450° F. Another such characteristic is the adhesion of the material. In some embodiments, it is desirable that the material adhere to the tiles and/or to the top and/or backing layers, and a higher adhesion would therefore be desired. Another characteristic is the modulus of the material. The gap-filling material in some embodiments provides support for the tiles during pre-pultrusion handling. Additionally, in some embodiments, the gap-filling material provides impact resistance and/or serves to mitigate the propagation of the force of impact from one tile to the next and to prevent tile-to-tile contact. Still another characteristic is the pot life of the material. As the tile arrays can have a large number of gaps to be filled with material, a longer pot life can permit more of the gaps to be filled from a single material batch. Viscosity is another characteristic to be considered. As the gaps being filled are typically small, for example, 0.030 inches in width, lower viscosities can reduce the force required to push the material into the gap, and can reduce the potential for porosity developing during the application and/or curing of the material.

Exemplary environmental conditions include, but are not limited to, temperatures, and humidity ranges under which the armor is to be used, and shock and vibration input. These are also among the conditions (on a macro scale) the ballistic screens would be exposed to during shipment, storage, installation and use.

In some embodiments, the gap-filling material comprises a phenolic resin, such as, for example, one of the Cellobond resins from Blagden Chemicals, Ltd. In other embodiments, the gap-filling material comprises an elastomer, such as, for example, one of the Conathane® products from Cytec Industries, Inc. In still other embodiments, the gap-filling material comprises an epoxy, such as, for example, one of the Magnolia epoxies of Magnolia Plastics, Inc. In yet other embodiments, the gap-filling material comprises a cyanoacrylate, such as, for example, a Loctite® cyanoacrylate from Henkel Corp. Typical material characteristics of these materials are listed in Table 1.

TABLE 1

| Filler | Max. Temp. (° F.) | Adhesion (psi) | Modulus (psi) | Pot Life | Viscosity (cP) |
|---|---|---|---|---|---|
| Phenolic Resin | 266-356 | 1520-2700 | 200k-3,050k | 4 min.-50 hrs. | 350 |
| Elastomer | 250-600 | 1100 | 20-5000 | 34-80 min. | 220-6800 |
| Epoxy | 313-496 | 320-4250 | 250k-500k | 2-5 hrs. | 200-10,000 |
| Cyanoacrylate | 482 | 2600-4000 | 725-2175 | 5-60 sec. | 2-1600 |

The optional reinforcement additive is selected to provide additional strength to the material itself more resistant to impact as well as to increase the ability of the gap-filling material to prohibit tile-to-tile contact and/or prevent impact shock from passing from one tile to the next. The particles are thought to break up the shock wave of an impact into smaller waves having less energy. One characteristic to be considered in selecting an appropriate reinforcement additive is the particle size of the additive. The particles should be small enough to fit within the small tile-to-tile gaps, and in some embodiments should be small enough to reduce the tendency to align uniaxially due to the size in relation to the gap size. In some embodiments, for example, having a tile-to-tile nominal gap of 0.030 inches, fiber sizes should be small enough to allow for random orientation of fibers and/or grit particles for optimum properties and performance. Exemplary reinforcement additives include carbon nanotubes, milled carbon fibers, milled glass fibers and/or silicon carbide (SiC) grit. Typical particle sizes for these materials are:

Carbon Nanotubes: 40-50 nm diameter (ropes)

Milled Carbon Fiber: 7 micron diameter, 130 micron length

Milled Glass Fiber: 0.031 inches in length

SiC Grit: variable.

Figure 10:
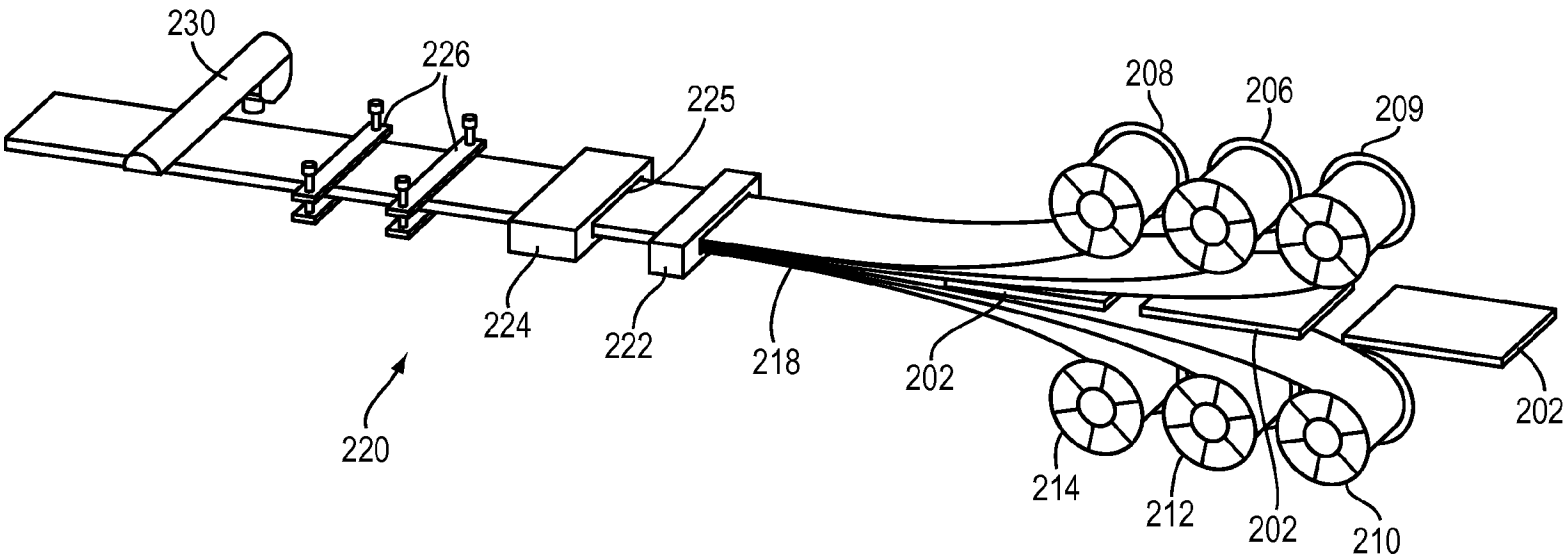
FIG. 10 is a perspective view of a process of making armor by pultrusion in accordance with certain embodiments of the invention.

An armor component is formed in accordance with certain aspects of the invention by first arranging a set of tiles and spacers on a rigid support in a desired pattern or arrangement to form a tile array, as is exemplified in FIGS. 5 and 9. Gap filler material is prepared, and where such is desired, one or more reinforcement additives are intermixed into the gap-filling material. The gap-filling material is introduced into the gaps between the tiles to form an armor sub-assembly 202, illustrated in FIG. 10. The armor sub-assembly 202 is fed between rolls of dry fabric 204, 206, 208 on the top and 210, 212, 214 on the bottom, forming a composite sub-assembly 218. It is to be appreciated that any number of fabric layers can make up the top and/or bottom layer of the armor composite sub-assembly. Exemplary dry fabric layers include layers comprising fiberglass, for example, one or more layers of a fiberglass weave, woven or non-woven para-aramid (for example, Kevlar™), ultra-high molecular weight polyethylene (for example, Dyneema® or Spectra® polyethylene fabrics), carbon fiber, and/or combinations of these. Generally, the armor sub-assembly will be sandwiched by at least a first fabric layer on the top and at least a second fabric layer on the bottom, which can be the same as or different than the first layer.

The composite sub-assembly 218 is then introduced into a pultruder 220. Resin, for example, polyester, polyurethane, vinylester, phenolic, thermoplastic and/or epoxy resin, is impregnated into the composite sub-assembly 218 by a resin impregnation dye 222, optionally under pressure. The resin-impregnated sub-assembly 223 is then fed into a heated dye 224, which applies heat and/or pressure to cure the resin. The cross-sectional shape of the cavity 225 of the heated dye 224 determines the cross-sectional shape of the final armor, as the composite laminate solidifies in the shape of the dye. In some embodiments, the heated dye is set to a temperature sufficient to cure the resin.

In certain embodiments, the now-formed armor 218 is run through a pair of alternating pullers 226, which serve to pull the composite sub-assemblies 218 through the pultruder in a continuous fashion. The armor is optionally cut into pieces, for example, by an automatic cutoff saw 230.

Figure 11:
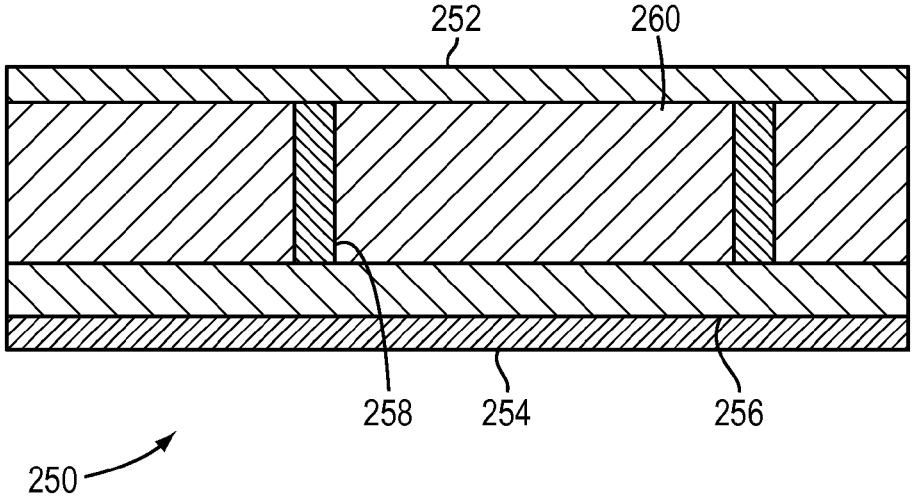
FIG. 11 is a cross-sectional view of a tile armor embodiment.

This process results in a composite armor, an embodiment of which is illustrated in cross-section in FIG. 11. In that embodiment, composite armor 250 includes a first layer 252 and a second layer 254 that sandwich a rigid support 256 having ceramic tiles 260 thereupon, and having a gap-filling material 258 disposed between the ceramic tiles 260.

In some embodiments, the composite sub-assembly has hardware installed to assist in installation of the completed armor. For example, inserts can be embedded in one or more of the fabric layers to assist with installation. Exemplary inserts include, for example, eyelets, hooks, magnets or channels to assist with installation. In other embodiments, a continuous attachment layer or partial layer can be added to the composite sub-assembly. In some embodiments, the armor panels can be installed by means of components that retain one or more edges of the panels to hold the panels in place.

Armor formed in accordance with any of the aspects and embodiments disclosed above can be used in any situation where protection from projectile rounds or other ballistic threats is desired. In some embodiments, such armor can be attached a vehicle, for example, to any number of interior and/or exterior surfaces of the vehicle, to protect the occupants and contents of the vehicle from projectiles. Similarly, the armor can be attached to boats or aircraft, such as planes and helicopters, to protect the occupants and contents thereof. The armor can be applied to select areas of any of these for protection of specific portions of the vehicle and/or to protect against specific threats. For example, the floor of a military vehicle could be armored to protect against damage from mines, or the seatbacks of aircraft seats could be armored to protect against machine gun or cannon fire from the rear of the aircraft, as by a trailing aircraft. The armor can also be used to strengthen and protect structures, such as, for example, personnel structures, command centers, and munition dumps. Due to the low weight of the armor, relative to steel-based armor, the armor is particularly useful where minimizing weight is a concern. For example, the armor can be used to armor temporary, portable structures that may lack the structural integrity to support heavier armor.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An armor component comprising:

a plurality of ceramic tiles, each ceramic tile having an edge adjacent an edge of another ceramic tile;

a spacer disposed between the edges of at least two adjacent ceramic tiles to form a gap between adjacent edges, the gap having a thickness of between about 0.015 inches and about 0.050 inches; and a gap filling material disposed between and filling substantially all of the space between adjacent ceramic tiles, wherein the spacer comprises metal.

2. The armor component of claim 1, wherein the spacer comprises two spacer arms, each spacer arm having a thickness of between about 0.007 inches and about 0.025 inches.

3. The armor component of claim 1, wherein the spacer comprises three spacer arms, each spacer arm having a thickness of between about 0.015 inches and about 0.050 inches.

4. The armor component of claim 1, wherein the spacer comprises four spacer arms, each spacer arm having a thickness of between about 0.015 inches and about 0.050 inches.

5. The armor component of claim 1, wherein the spacer is attached to at least one tile by an adhesive.

6. The armor component of claim 1, wherein the gap filling material comprises a polymer.

7. The armor component of claim 1, wherein the gap filling material is selected from the group consisting of a phenolic resin, an elastomer, an epoxy, and a cyanoacrylate.

8. The armor component of claim 1, wherein the gap filling material comprises an epoxy.

9. The armor component of claim 1, wherein the gap filling material comprises a reinforcement additive.

10. The armor component of claim 9, wherein the reinforcement additive is selected from the group consisting of carbon nanotubes, milled carbon fibers, glass fibers, and silicon carbide grit.

11. The armor component of claim 1, further comprising a rigid support on which the tiles and gap filling material are disposed.

12. The armor component of claim 11, wherein the rigid support comprises a lipped edge that abuts the outer edge of the plurality of tiles.

13. A component comprising:

a first layer;

a second layer adjacent the first layer, the second layer comprising a rigid support;

a third layer adjacent the second layer, the third layer comprising:

a plurality of ceramic tiles, each ceramic tile having an edge adjacent an edge of another ceramic tile;

a spacer disposed between the edges of at least two adjacent ceramic tiles to form a gap between adjacent edges, the gap having a thickness of between about 0.015 inches and about 0.050 inches; and a gap filling material disposed between and filling substantially all of the space between adjacent ceramic tiles; and a fourth layer adjacent the third layer, wherein the spacer comprises metal.

14. The component of claim 13, wherein the tiles are ballistic tiles.

15. A method of making tiled armor, the method comprising:

placing tiles and spacers on a rigid support; and arranging tiles in a pattern on the rigid support so that there is at least one spacer between adjacent tiles and there is a gap between adjacent tiles of between about 0.015 inches and about 0.050 inches, wherein the spacer comprises metal.

16. The method of claim 15, where the spacers contact each of at least two adjacent tiles.

17. The method of claim 15, further comprising adhering the spacers to at least one tile.

18. The method of claim 15, further comprising filling the gap between adjacent tiles with a gap filling material to form a tile sub-assembly.

19. The method of claim 18, wherein the gap filling material is selected from the group consisting of a phenolic resin, an elastomer, an epoxy, and a cyanoacrylate.

20. The method of claim 19, wherein the gap filling material is an epoxy.

21. The method of claim 18, wherein the gap filling material comprises a reinforcement additive.

22. The method of claim 21, wherein the reinforcement additive is selected from the group consisting of carbon nanotubes, milled carbon fibers, glass fibers, and silicon carbide grit.

23. The method of claim 15, further comprising sandwiching the tile sub-assembly between a first and a second layer to form a composite sub-assembly.

24. The method of claim 23, further comprising adding additional layers to the composite sub-assembly.

25. The method of claim 23, further comprising impregnating the composite sub-assembly with resin and curing the resin.

26. The method of claim 25, wherein the resin is cured at a temperature of at least about 425° F.

* * * * *